US010877421B2

(12) United States Patent
Okumura

(10) Patent No.: US 10,877,421 B2
(45) Date of Patent: Dec. 29, 2020

(54) IMAGE FORMING APPARATUS AND IMAGE FORMING METHOD

(71) Applicant: KYOCERA Document Solutions Inc., Osaka (JP)

(72) Inventor: Ryuichi Okumura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/727,225

(22) Filed: Dec. 26, 2019

(65) Prior Publication Data

US 2020/0209795 A1 Jul. 2, 2020

(30) Foreign Application Priority Data

Dec. 28, 2018 (JP) ..... 2018-248479

(51) Int. Cl.
*G03G 15/00* (2006.01)

(52) U.S. Cl.
CPC ... *G03G 15/55* (2013.01); *G03G 2215/00067* (2013.01); *G03G 2215/00628* (2013.01); *G03G 2215/00637* (2013.01)

(58) Field of Classification Search
CPC ..... G03G 15/55; G03G 15/553
USPC ..... 399/8, 9, 16, 18, 24, 31
See application file for complete search history.

(56) References Cited

U.S. PATENT DOCUMENTS

| | | | | |
|---|---|---|---|---|
| 7,243,045 | B2 | 7/2007 | Uwatoko et al. | |
| 7,457,550 | B2 * | 11/2008 | Shoji | G03G 15/55 399/9 |
| 7,877,049 | B2 * | 1/2011 | Ikeda | G03G 15/55 399/301 |
| 8,036,546 | B2 * | 10/2011 | Misumi | G03G 15/5079 399/36 |
| 9,523,955 | B2 * | 12/2016 | Horita | G03G 15/6529 |
| 10,084,805 | B2 * | 9/2018 | Nadolski | G06N 3/0445 |
| 2005/0240376 | A1 | 10/2005 | Uwatoko et al. | |

FOREIGN PATENT DOCUMENTS

JP 2005309078 A 11/2005

* cited by examiner

*Primary Examiner* — Hoan H Tran
(74) *Attorney, Agent, or Firm* — Studebaker & Brackett PC

(57) ABSTRACT

An image forming apparatus includes an image forming section, a measuring section, a generating section, and a predicting section. The image forming section forms an image on a sheet. The measuring section measures sound or vibration in the image forming section to obtain a measured result. The generating section generates frequency data through a frequency analysis of the measured result. The predicting section predicts a malfunction to occur of the image forming section based on the frequency data.

9 Claims, 9 Drawing Sheets

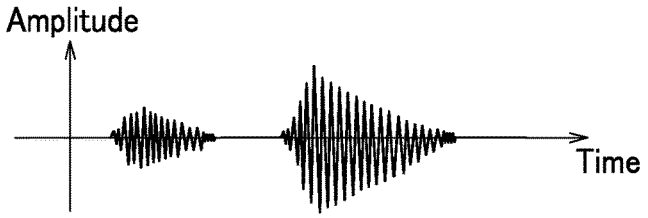
FIG. 3A
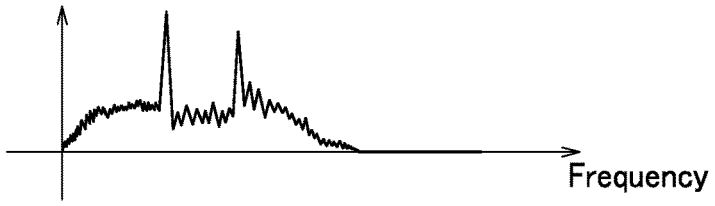
FIG. 3B
| No. | Date and time | Sound | Vibration | Status |
|---|---|---|---|---|
| ⋮ | ⋮ | ⋮ | ⋮ | ⋮ |
| 36 | 2018-09-01 10:08 | D36 | d36 | Normal |
| 37 | 2018-09-01 11:22 | D37 | d37 | Normal |
| 38 | 2018-09-01 13:35 | D38 | d38 | Abnormal |
| 39 | 2018-09-01 14:46 | D39 | d39 | Normal |
| ⋮ | ⋮ | ⋮ | ⋮ | ⋮ |
| 62 | 2018-09-04 10:48 | D62 | d62 | Normal |
| 63 | 2018-09-04 11:25 | D63 | d63 | Abnormal |
| 64 | 2018-09-04 12:07 | D64 | d64 | Normal |
| | | | | |
FIG. 3C
| No. | Date and time | Sound | Vibration | Malfunction occurrence probability |
|---|---|---|---|---|
| ⋮ | ⋮ | ⋮ | ⋮ | ⋮ |
| 115 | 2018-09-09 11:36 | D115 | d115 | 20% |
| 116 | 2018-09-09 12:54 | D116 | d116 | 80% |
| ⋮ | ⋮ | ⋮ | ⋮ | ⋮ |
FIG. 3D

| No. | Date and time | Sound | Vibration | Printing condition | Cumulative number of prints | Status |
|---|---|---|---|---|---|---|
| ⋮ | ⋮ | ⋮ | ⋮ | ⋮ | ⋮ | ⋮ |
| 51 | 2018-09-02 14:26 | D51 | d51 | Monochrome, 2in1, 4 prints | 5030 | Normal |
| 52 | 2018-09-02 14:43 | D52 | d52 | Color, 2 prints | 5032 | Normal |
| 53 | 2018-09-02 14:57 | D53 | d53 | Monochrome, 4in1, 16 prints | 5048 | Abnormal |
| 54 | 2018-09-02 15:01 | D54 | d54 | Color, 2in1, 2 prints | 5050 | Normal |
| ⋮ | ⋮ | ⋮ | ⋮ | ⋮ | ⋮ | ⋮ |

FIG. 5A

| No. | Date and time | Sound | Vibration | Printing condition | Cumulative number of prints | Malfunction occurrence probability |
|---|---|---|---|---|---|---|
| ⋮ | ⋮ | ⋮ | ⋮ | ⋮ | ⋮ | ⋮ |
| 153 | 2018-09-08 10:08 | D153 | d153 | Monochrome, 2in1, 4 prints | 4258 | 10% |
| 154 | 2018-09-08 10:53 | D154 | d154 | Color, 2 prints | 4260 | 15% |
| 155 | 2018-09-08 11:27 | D155 | d155 | Monochrome, 4in1, 16 prints | 4276 | 80% |
| ⋮ | ⋮ | ⋮ | ⋮ | ⋮ | ⋮ | ⋮ |

FIG. 5B

| No. | Date and time | First sound sensor | First vibration sensor | Status | Second sound sensor | Second vibration sensor | Status | |
|---|---|---|---|---|---|---|---|---|
| ⋮ | ⋮ | ⋮ | ⋮ | ⋮ | ⋮ | ⋮ | ⋮ | |
| 42 | 2018-09-05 10:36 | Da42 | da42 | Normal | Db42 | db42 | Normal | ⋯ |
| 43 | 2018-09-05 10:58 | Da43 | da43 | Normal | Db43 | db43 | Abnormal | ⋯ |
| 44 | 2018-09-05 11:42 | Da44 | da44 | Abnormal | Db44 | db44 | Normal | ⋯ |
| 45 | 2018-09-05 12:15 | Da45 | da45 | Normal | Db45 | db45 | Normal | ⋯ |
| ⋮ | ⋮ | ⋮ | ⋮ | ⋮ | ⋮ | ⋮ | ⋮ | |

FIG. 7A

| No. | Date and time | First sound sensor | First vibration sensor | Malfunction occurrence probability | Second sound sensor | Second vibration sensor | Malfunction occurrence probability | |
|---|---|---|---|---|---|---|---|---|
| ⋮ | ⋮ | ⋮ | ⋮ | ⋮ | ⋮ | ⋮ | ⋮ | |
| 122 | 2018-09-08 13:22 | Da122 | da122 | 15% | Db122 | db122 | 2% | ⋯ |
| 123 | 2018-09-08 14:51 | Da123 | da123 | 3% | Db123 | db123 | 95% | ⋯ |
| 124 | 2018-09-09 15:36 | Da124 | da124 | 85% | Db124 | db124 | 10% | ⋯ |
| ⋮ | ⋮ | ⋮ | ⋮ | ⋮ | ⋮ | ⋮ | ⋮ | ⋯ |

FIG. 7B

| No. | Date and time | First sound measuring section | First vibration measuring section | Status | Second sound measuring section | Second vibration measuring section | Status | |
|---|---|---|---|---|---|---|---|---|
| ⋮ | ⋮ | ⋮ | ⋮ | ⋮ | ⋮ | ⋮ | ⋮ | |
| 28 | 2018-09-03 10:05 | Da28 | da28 | Normal | Db28 | db28 | Normal | ⋯ |
| 29 | 2018-09-03 11:30 | Da29 | da29 | Normal | Db29 | db29 | Abnormal | ⋯ |
| 30 | 2018-09-03 13:45 | Da30 | da30 | Abnormal | Db30 | db30 | Normal | ⋯ |
| 31 | 2018-09-03 14:15 | Da31 | da31 | Normal | Db31 | db31 | Normal | ⋯ |
| ⋮ | ⋮ | ⋮ | ⋮ | ⋮ | ⋮ | ⋮ | ⋮ | |

FIG. 9A

| No. | Date and time | First sound measuring section | First vibration measuring section | Malfunction occurrence probability | Second sound measuring section | Second vibration measuring section | Malfunction occurrence probability | |
|---|---|---|---|---|---|---|---|---|
| ⋮ | ⋮ | ⋮ | ⋮ | ⋮ | ⋮ | ⋮ | ⋮ | |
| 86 | 2018-09-09 11:12 | Da86 | da86 | 3% | Db86 | db86 | 2% | ⋯ |
| 87 | 2018-09-09 13:04 | Da87 | da87 | 4% | Db87 | db87 | 96% | ⋯ |
| 88 | 2018-09-09 14:50 | Da88 | da88 | 89% | Db88 | db88 | 5% | ⋯ |
| ⋮ | ⋮ | ⋮ | ⋮ | ⋮ | ⋮ | ⋮ | ⋮ | ⋯ |

FIG. 9B

IMAGE FORMING APPARATUS AND IMAGE FORMING METHOD

INCORPORATION BY REFERENCE

The present application claims priority under 35 U.S.C. § 119 to Japanese Patent Application No. 2018-248479, filed on Dec. 28, 2018. The contents of this application are incorporated herein by reference in their entirety.

BACKGROUND

The present disclosure relates to an image forming apparatus and an image forming method.

In an image forming apparatus, prediction of a failure to occur of the image forming apparatus has been studied in order to quickly resolve the failure. The image forming apparatus predicts the failure to occur of the image forming apparatus based on an output image formed by the image forming apparatus.

SUMMARY

An image forming apparatus according to an aspect of the present disclosure includes an image forming section, a measuring section, a generating section, and a predicting section. The image forming section forms an image on a sheet. The measuring section measures sound or vibration in the image forming section to obtain a measurement result. The generating section generates frequency data through a frequency analysis of the measurement result. The predicting section predicts a malfunction to occur of the image forming section based on the frequency data.

An image forming method according to an aspect of the present disclosure includes forming an image on a sheet by an image forming section, measuring sound or vibration in the image forming section to obtain a measurement result, generating frequency data through a frequency analysis of the measurement result, and predicting a malfunction to occur of the image forming section based on the frequency data.

BRIEF DESCRIPTION OF THE DRAWINGS

FIG. 3A is a graph depicting a measurement result by a measuring section in the image forming apparatus according to the present embodiment.

FIG. 3B is a graph depicting frequency data generated by a generating section in the image forming apparatus according to the present embodiment.

FIG. 3C is a table that represents learning data on the image forming apparatus according to the present embodiment.

FIG. 3D is a table that represents sound frequency data, vibration frequency data, and a malfunction occurrence probability in an image forming section in the image forming apparatus according to the present embodiment.

FIG. 5A is a table that represents learning data used for prediction in the image forming apparatus according to the present embodiment.

FIG. 5B is a table represents sound frequency data, vibration frequency data, printing conditions, cumulative number of prints, and a malfunction occurrence probability of the image forming apparatus according to the present embodiment.

FIG. 7A is a table that represents learning data used for prediction in the image forming apparatus according to the present embodiment.

FIG. 7B is a table that represents sound frequency data, vibration frequency data, and a malfunction occurrence probability for each sensor in the image forming apparatus according to the present embodiment.

FIG. 9A is a table that represents learning data used for prediction in the image forming system according to the present embodiment.

FIG. 9B is a table that represents sound frequency data, vibration frequency data, and a malfunction occurrence probability for each image forming apparatus in an image forming system according to the present embodiment.

DETAILED DESCRIPTION

Figure 1:
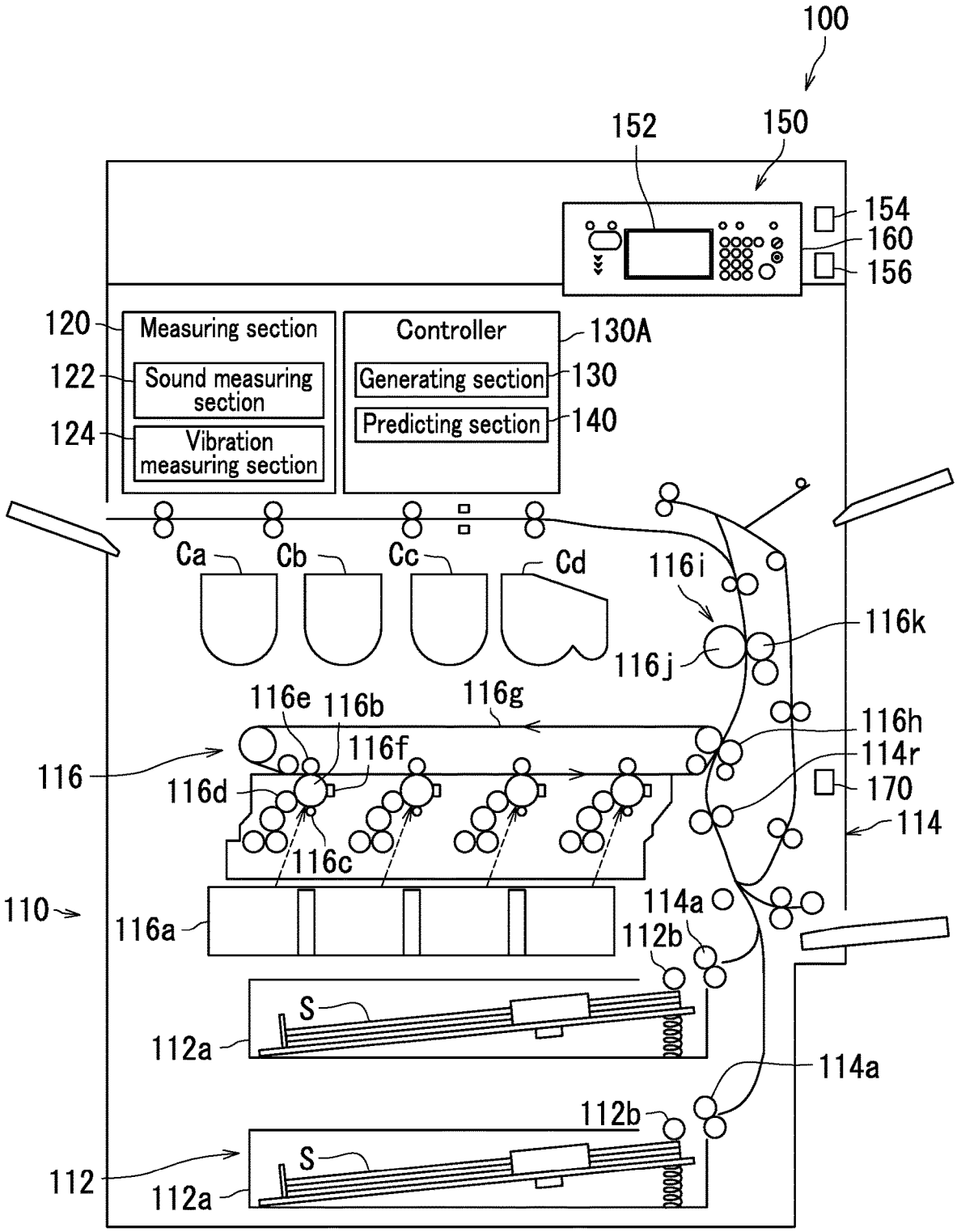
FIG. 1 is a schematic illustration of an image forming apparatus according to an embodiment.

An embodiment of the present disclosure will hereinafter be described with reference to the accompanying drawings. Elements that are the same or equivalent are labelled with the same reference signs in the drawings and description thereof is not repeated.

A configuration of an image forming apparatus 100 according to the present embodiment will first be described with reference to FIG. 1. FIG. 1 is a schematic illustration of the image forming apparatus 100. The image forming apparatus 100 forms an image on a sheet S. Examples of the image forming apparatus 100 include a printer, a photocopier, and a multifunction peripheral. The image forming apparatus 100 may have a facsimile function. Here, the image forming apparatus 100 is an electrographic apparatus.

The image forming apparatus 100 includes an image forming section 110, a measuring section 120, a generating section 130, and a predicting section 140. The image forming section 110, the measuring section 120, the generating section 130, and the predicting section 140 are disposed in a housing of the image forming apparatus 100.

The image forming section 110 forms the image on the sheet S. Examples of the sheet S include a plain paper sheet, a recycled paper sheet, a thin paper sheet, a sheet of cardboard, a coated paper sheet, and an overhead projector (OHP) sheet.

The measuring section 120 measures sound or vibration in the image forming section 110. For example, the measuring section 120 includes a microphone that measures sound to obtain a sound measurement result. Alternatively or additionally, the measuring section 120 includes a vibration meter that measures vibration to obtain a vibration measurement result.

The generating section 130 generates frequency data through a frequency analysis of the measurement result by the measuring section 120. For example, the generating section 130 generates sound frequency data from the sound measurement result by the measuring section 120. Alternatively or additionally, the generating section 130 generates vibration frequency data from the vibration measurement result by the measuring section 120. For example, the generating section 130 generates frequency data through a fast Fourier transform (FFT) process of the measurement result by the measuring section 120. For example, the frequency data is also utilized as learning data.

The predicting section 140 predicts a malfunction to occur of the image forming section 110 based on the frequency data generated by the generating section 130. For example, the predicting section 140 obtains a machine learning result through machine learning of the frequency data generated by the generating section 130, and predicts the malfunction to occur of the image forming section 110 based on the machine learning result. The predicting section 140 may use a convolutional neural network (CNN) process for the machine learning.

In order to perform the learning through the CNN process, the frequency data is employed as input, while a status identifier of the image forming apparatus 100 is employed as output. Here, the status identifier identifies presence or absence of a failure or a malfunction of the image forming apparatus 100. Note that in addition to an input layer and an output layer, the convolutional neural network may include one hidden layer, or two or more hidden layers. In this case, when the CNN process is performed, a malfunction occurrence probability of the image forming section 110 is output in response to the input of the frequency data.

Examples of the malfunction of the image forming section 110 include an abnormal state occurring in the image forming section 110. Typically, when the abnormal state occurs in the image forming section 110, the operation of the image forming section 110 is stopped. Examples of the abnormal state include JAM and a call for a maintenance person.

Alternatively or additionally, the malfunction of the image forming section 110 includes a change in an image forming operation. For example, when the sheet S is slightly diagonally conveyed in the image forming section 110, the operation of the image forming section 110 is not stopped as long as a position of the sheet S is in a normal range. Even in this case, it may be determined that the malfunction occurs in the image forming section 110.

When the predicting section 140 performs learning, the predicting section 140 performs learning on past pieces of frequency data and past pieces of status identifiers about the image forming section 110. Such learning is performed by using a classifier. The predicting section 140 predicts the malfunction of the image forming section 110 based on frequency data.

The predicting section 140 may obtain a prediction result of the malfunction of the image forming section 110 as the malfunction occurrence probability. The malfunction occurrence probability is expressed as 0% to 100%.

The generating section 130 and the predicting section 140 are included in a controller 130A. The controller 130A controls the image forming section 110. The controller 130A includes a logic device. The logic device includes a processor. In an example, the processor includes a central processing unit (CPU). The processor may include an application specific integrated circuit (ASIC).

The image forming section 110 includes a feeding section 112, a conveyance section 114, and an imaging section 116. The feeding section 112 allows sheets S to be housed therein. The feeding section 112 feeds the sheets S on a sheet-by-sheet basis according to an instruction from the controller 130A.

The feeding section 112 includes a cassette 112*a* and a feeding roller 112*b*. The cassette 112*a* allows the sheets S to be housed therein. The feeding roller 112*b* performs individual feeding of the sheets P housed in the cassette 112*a*. The feeding roller 112*b* performs feeding of the sheets P housed in the cassette 112*a* from an uppermost sheet S on a sheet-by-sheet basis. Here, the feeding section 112 includes, as the cassette 112*a* and the feeding roller 112*b*, cassettes 112*a* and feeding rollers 112*b*. The feeding rollers 112*b* are installed in the cassettes 112*a*, respectively.

The conveyance section 114 conveys a sheet S fed by the feeding section 112 to the imaging section 116. Specifically, the conveyance section 114 conveys sheets P fed by the feeding section 112 to the imaging section 116 on a sheet-by-sheet basis. The imaging section 116 forms an image on the sheet S, and subsequently the conveyance section 114 conveys the sheet P from the imaging section 116, thereby ejecting the sheet S outside the image forming apparatus 100.

The conveyance section 114 includes conveyance rollers 114*a*. The conveyance rollers 114*a* convey the sheet S. In the conveyance section 114, a conveyance path of the sheet S is formed by the conveyance rollers 114*a*.

Each of the conveyance rollers 114*a* includes a roller. The rotating roller rotates around a rotation axis. Typically, the conveyance rollers 114*a* include pairs of rotating rollers. Each of the pairs of rotating rollers is opposite each other and rotates around respective rotation axes. In an example, of each pair of rotating rollers, a first rotating roller rotates according to power of a motor, and a second rotating roller rotates following the rotation of the first rotating roller. The sheet S enters between each pair of rotating rollers that are rotating, and is urged by the rotating rollers and pushed out of the rotating rollers.

The conveyance rollers 114*a* include a registration roller 114*r*. The registration roller 114*r* adjusts conveyance timing of the sheet S to the imaging section 116. The registration roller 114*r* temporarily stops the conveyance of the sheet S and conveys the sheet S to the imaging section 116 in accordance with a predetermined timing for the imaging section 116.

Toner containers Ca to Cd are mounted on the image forming apparatus 100. The image forming apparatus 100 allows each of the toner containers Ca to Cd to be detachably attached thereto. Each of the toner containers Ca to Cd houses different color toner. The image forming apparatus 100 is supplied with toner of each of the toner containers Ca to Cd. The image forming apparatus 100 forms an image by using the toner supplied from each of the toner containers Ca to Cd.

For example, the toner container Ca houses yellow toner, and supplies the yellow toner to the imaging section 116. The toner container Cb houses magenta toner, and supplies the magenta toner to the imaging section 116. The toner container Cc houses cyan toner, and supplies the cyan toner to the imaging section 116. The toner container Cd houses black toner, and supplies the black toner to the imaging section 116.

The imaging section 116 uses toner housed in the toner containers Ca to Cd, thereby forming an image on the sheet S based on image data. Here, the imaging section 116 includes an exposure section 116*a*, a photosensitive drum 116*b*, a charger 116*c*, a developing section 116*d*, a primary transfer roller 116*e*, a cleaning section 116*f*, an intermediate transfer belt 116*g*, a secondary transfer roller 116*h*, and a fixing section 116*i*.

The intermediate transfer belt 116*g* is rotated by a rotating roller that is rotating according to power of a motor. A motor is attached to the developing section 116*d*. The toner inside the developing section 116*d* is stirred by rotation of the motor.

The photosensitive drum 116*b*, the charger 116*c*, the developing section 116*d*, the primary transfer roller 116*e*, and the cleaning section 116*f* are provided for each of the toner containers Ca to Cd. The photosensitive drums 116*b* are in contact with a flat outer surface of the intermediate transfer belt 116*g* to be rotated in a rotation direction, and disposed along the flat outer surface. The primary transfer rollers 116*e* are provided for the photosensitive drums 116*b*, respectively. The primary transfer rollers 116*e* are opposite the photosensitive drums 116*b* through the intermediate transfer belt 116*g*, respectively.

Each charger 116*c* charges a peripheral surface of a corresponding photosensitive drum 116*b*. The exposure section 116*a* throws light based on the image data onto each of the photosensitive drums 116*b*, thereby forming a corresponding electrostatic latent image on the peripheral surface of each photosensitive drum 116*b*. Each developing section 116*d* attaches corresponding toner to a corresponding electrostatic latent image and develops the electrostatic latent image, thereby forming a corresponding toner image on the peripheral surface of a corresponding photosensitive drum 116*b*. The corresponding photosensitive drum 116*b* therefore carries the corresponding toner image. A corresponding primary transfer roller 116*e* transfers the corresponding toner image formed on the photosensitive drum 116*b* to the outer surface of the intermediate transfer belt 116*g*. Each cleaning section 116*f* removes the toner remaining on the peripheral surface of a corresponding photosensitive drum 116*b*.

The photosensitive drum 116*b* corresponding to the toner container Ca forms a yellow toner image based on the corresponding electrostatic latent image, and the photosensitive drum 116*b* corresponding to the toner container Cb forms a magenta toner image based on the corresponding electrostatic latent image. The photosensitive drum 116*b* corresponding to the toner container Cc forms a cyan toner image based on the corresponding electrostatic latent image, and the photosensitive drum 116*b* corresponding to the toner container Cd forms a black toner image based on the corresponding electrostatic latent image.

Different color toner images on the photosensitive drums 116*b* are transferred and superposed onto the outer surface of the intermediate transfer belt 116*g*, and an image is formed thereon. The intermediate transfer belt 116*g* therefore carries the image. The secondary transfer roller 116*h* transfers the image formed on the outer surface of the intermediate transfer belt 116*g* to the sheet S.

The fixing section 116*i* heats and pressurizes the sheet S on which the toner image is transferred, thereby fixing the toner image on the sheet S. The fixing section 116*i* includes a heating roller 116*j* and a pressure roller 116*k*. The heating roller 116*j* and the pressure roller 116*k* are opposite each other, and form a fixing nip. The sheet S passes between the intermediate transfer belt 116*g* and the secondary transfer roller 116*h*, and then passes the fixing nip. The sheet S is thereby pressurized while being heated at a predetermined fixing temperature. The toner image is consequently fixed on the sheet S. The conveyance section 114 ejects the sheet S on which the toner image is fixed outside the image forming apparatus 100.

Here, the measuring section 120 includes a sound measuring section 122 and a vibration measuring section 124. The sound measuring section 120 measures sound generated in the image forming section 110. For example, the sound measuring section 122 measures sound generated by the motors of the image forming section 110. Alternatively, the sound measuring section 122 measures sound of the sheet S being conveyed in the conveyance section 114.

The vibration measuring section 124 measures vibration occurring in the image forming section 110. For example, the vibration measuring section 124 measures vibration generated by the motors of the image forming section 110. Alternatively, the vibration measuring section 124 measures vibration applied to the sheet S being conveyed in the conveyance section 114.

The image forming apparatus 100 may further include an output section 150. The predicting section 140 performs prediction of a malfunction of the image forming section 110 to obtain a prediction result, and then the output section 150 outputs the prediction result by the predicting section 140 to a user.

The output section 150 includes a display section 152, an audio output section 154, and a communication section 156. The display section 152 may display various images. The display section 152 may include a liquid-crystal display. The display section 152 displays the prediction result by the predicting section 140 on a display thereof.

The audio output section 154 outputs an audio sound. By the audio sound, the audio output section 154 outputs the prediction result by the predicting section 140 to the user.

The communication section 156 transmits information or data to an external device, and receives information or data from the external device. Examples of the external device include a server and information processing terminals of the user, an administrator, and the maintenance person of the image forming apparatus 100. The communication section 156 transmits the prediction result by the predicting section 140 to the external device.

Note that the communication section 156 may transmit, to the external device, sound frequency data, vibration frequency data, and a status identifier generated in the generating section 130. In this case, the data generated in the image forming apparatus 100 may be utilized as learning data of a different image forming apparatus.

Alternatively, the communication section 156 may receive, from the external device, sound frequency data, vibration frequency data, and a status identifier generated in a generating section of the different image forming apparatus. In this case, the data generated in the different image forming apparatus may be utilized as learning data of the image forming apparatus 100.

Alternatively, the image forming apparatus 100 may exchange data with the different image forming apparatus via a portable information recording medium. For example, the sound frequency data, the vibration frequency data, and the status identifier generated in the generating section 130 may be utilized by the different image forming apparatus via universal serial bus (USB) memory. Alternatively, the image forming apparatus 100 may receive, via USB memory, the sound frequency data, the vibration frequency data, and the status identifier generated in the generating section of the different forming apparatus. Note that when the predicting section 140 performs the prediction of the malfunction of the image forming section 110 based on data generated in the generating section 130 of the image forming apparatus 100 and data generated in the generating section of the different image forming apparatus, the data generated in the generating section 130 may be used with a higher weight than the data generated in the generating section of the different image forming apparatus.

The image forming apparatus 100 may further include an input section 160. The input section 160 allows the user to enter an operation thereinto. The input section 160 may be provided integrally with the display section 152. The input section 160 includes a touch panel. The touch panel detects contact from the user, thereby receiving an input operation from the user.

The image forming apparatus 100 further includes a temperature measuring section 170. The temperature measuring section 170 measures temperature inside the image forming apparatus 100. For example, the temperature measuring section 170 includes a thermistor. The thermistor detects the temperature according to a variation in electric resistance thereof.

Figure 2:
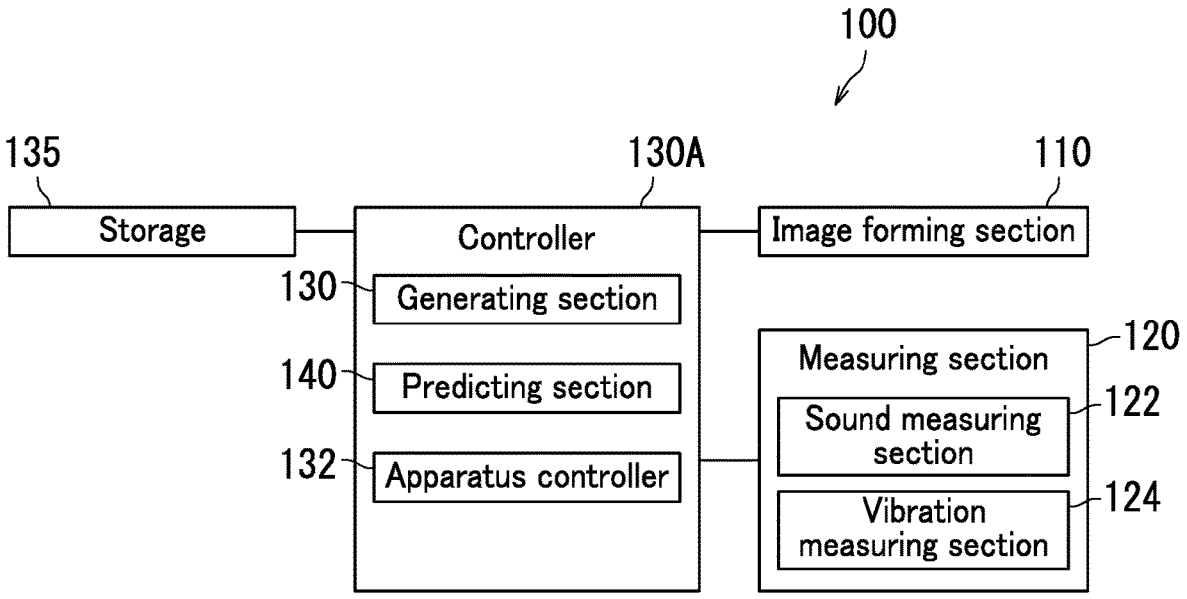
FIG. 2 is a block diagram of the image forming apparatus according to the present embodiment.

A configuration of the image forming apparatus 100 will next be described with reference to FIGS. 1 and 2. FIG. 2 is a block diagram of the image forming apparatus 100 according to the present embodiment.

In addition to the generating section 130 and the predicting section 140, the controller 130A includes an apparatus controller 132. The apparatus controller 132 controls the image forming section 110.

The image forming apparatus 100 further includes storage 135. The storage 135 includes a memory device. The storage 135 may include memory such as semiconductor memory. The storage 135 includes a main memory device such as semiconductor memory, and an auxiliary memory device such as semiconductor memory or a hard disk drive. The storage 135 may include removable media.

The storage 135 stores various pieces of data. For example, the storage 135 stores a control program. The controller 130A executes the control program, thereby controlling an operation of the image forming apparatus 100. Specifically, the processor of the controller 130A executes a computer program stored in the memory device of the storage 135, thereby controlling components of the image forming apparatus 100. For example, the controller 130A executes the computer program, thereby realizing the generating section 130 and the predicting section 140.

For example, the computer program is stored in a non-transitory computer readable medium. Examples of the non-transitory computer readable medium include read only memory (ROM), random access memory (RAM), CD-ROM, a magnetic tape, a magnetic disk, and an optical data storage device.

The generating section 130, the apparatus controller 132 and/or the predicting section 140 store(s) information or data in the storage 135. The generating section 130, the apparatus controller 132 and/or the predicting section 140 read(s) information or data from the storage 135.

The prediction of the malfunction by the image forming apparatus 100 according to the embodiment will next be described with reference to FIGS. 1 to 3D. Each of FIGS. 3A to 3D is a graph or a table illustrating the prediction of the malfunction by the image forming apparatus 100.

FIG. 3A is a graph depicting a measurement result by the measuring section 120. As illustrated in FIG. 3A, the measuring section 120 measures an amplitude change with time of sound or vibration in the image forming section 110. The generating section 130 generates frequency data through a frequency analysis of the measurement result by the measuring section 120.

FIG. 3B is a graph depicting frequency data generated by the generating section 130. As illustrated in FIG. 3B, the frequency data represents magnitude versus frequency. The generating section 130 generates sound frequency data based on the sound measurement result by the measuring section 120. The generating section 130 also generates vibration frequency data based on the vibration measurement result by the measuring section 120.

FIG. 3C is a table that represents for each row, a data number, a sound and vibration measurement date and time, sound frequency data, vibration frequency data, and a status identifier. The storage 135 stores the table. Here, as illustrated in FIG. 3C, the storage 135 stores sound frequency data, vibration frequency data, and a status identifier of the image forming section 110 for each operation of the image forming section 110. The pieces of sound frequency data, the pieces of vibration frequency data, and the status identifiers are employed as learning data.

The status identifier represents presence or absence of an abnormal state in the image forming section 110. When a malfunction occurs in the image forming section 110, the table represents that the image forming section 110 is in an abnormal state. In contrast, when no malfunction occurs in the image forming section 110, the table represents that the image forming section 110 is in a normal state. For example, when JAM occurs in the image forming section 110, an abnormal state is stored in the table. Alternatively, when the display 152 displays an on-screen service call, an abnormal state is stored in the table. For example, the image forming apparatus 100 is set so that the display 152 displays the on-screen service call when an operation of engine software is locked, or when a specified motor or fan is in in an abnormal operation state.

A table in FIG. 3C represents, for each row, a data number, a sound and vibration measurement date and time, sound frequency data, vibration frequency data, and a status identifier of the image forming section 110. In the table illustrated in FIG. 3C, the date and time, the sound frequency data, the vibration frequency data, and the status identifier included in 36th data represent 10:08 on Sep. 1, 2018, D36, d36, and normal, respectively. In addition, the date and time, the sound frequency data, the vibration frequency data, and the status identifier included in 37th data represent 11:22 on Sep. 1, 2018, D37, d37, and normal, respectively.

The date and time, the sound frequency data, the vibration frequency data, and the status identifier included in 38th data represent 13:35 on Sep. 1, 2018, D38, d38, and abnormal, respectively. In addition, the date and time, the sound frequency data, the vibration frequency data, and the status identifier included in 39th data represent 14:46 on Sep. 1, 2018, D39, d39, and normal, respectively. From this, it is understood that a malfunction occurred in the image forming section 110 around 13:00 on Sep. 1, 2018, and then the malfunction was solved by some method.

The date and time, the sound frequency data, the vibration frequency data, and the status identifier included in 62nd data represent 10:48 on Sep. 4, 2018, D62, d62, and normal, respectively. In addition, the date and time, the sound frequency data, the vibration frequency data, and the status identifier included in 63rd data represent 11:25 on Sep. 4, 2018, D63, d63, and abnormal, respectively.

The date and time, the sound frequency data, the vibration frequency data, and the status identifier included in 64th data represent 12:07 on Sep. 4, 2018, D64, d64, and normal, respectively. From this, it is understood that a malfunction occurred in the image forming section 110 around 11:00 on Sep. 4, 2018, and then the malfunction was solved by some method.

The predicting section 140 predicts a malfunction of the image forming section 110 based on the learning data. FIG. 3D is a table that represents for each row, a data number, a sound and vibration measurement date and time, sound frequency data, vibration frequency data, a malfunction occurrence probability in the image forming apparatus 100 according to the present embodiment.

As illustrated in FIG. 3D, when the sound frequency data and the vibration frequency data included in 115th data measured at 11:36 on Sep. 9, 2018 represent D115 and d115, respectively, the predicting section 140 predicts occurrence of a malfunction of the image forming section 110 based on the frequency data of D115, the frequency data of d115, and the learning data. For example, the malfunction occurrence probability is 20%.

When the sound frequency data and the vibration frequency data included in 116th data measured at 12:54 on Sep. 9, 2018 represent D116 and d116, respectively, the predicting section 140 predicts occurrence of a malfunction of the image forming section 110 based on the frequency data of D116, the frequency data of d116, and the learning data. For example, the malfunction occurrence probability is 80%.

Note that the image forming apparatus 100 may provide the user with a possibility of malfunction occurrence of the image forming section 110 according to the malfunction occurrence probability. For example, the storage 135 stores therein a threshold for notifying the user of the malfunction occurrence. In an example, the threshold is 75%.

When the malfunction occurrence probability predicted by the predicting section 140 exceeds the threshold, the apparatus controller 132 controls the output section 150 so that the output section 150 provides the user with the possibility of the malfunction occurrence of the image forming section 110. For example, after the 116th data is measured, the output section 150 provides the user with the possibility of the malfunction occurrence of the image forming section 110.

In an example, the display section 152 displays, on the display thereof, an information message on the possibility of the malfunction occurrence of the image forming section 110. Alternatively or additionally, the audio output section 154 emits an audio sound to inform the user of the possibility of the malfunction occurrence of the image forming section 110.

Note that the intensity of sound and the intensity of vibration merely indicate the sum of respective amplitudes of frequency components in general, and therefore, if based on the intensity of sound and the intensity of vibration, a change in the image forming apparatus may be overlooked. The present embodiment enables a highly accurate prediction about a malfunction of the image forming section 110 because the malfunction of the image forming section 110 is predicted based on the sound frequency data and the vibration frequency data.

Note that although the storage 135 stores therein sound frequency data in FIG. 3C, vibration frequency data, and a status identifier for each operation of the image forming apparatus 100, the present embodiment is not limited to this. The storage 135 may store therein sound frequency data, vibration frequency data, and a status identifier measured at regular intervals. For example, the storage 135 may store therein sound frequency data, vibration frequency data, and a status identifier measured every 5 minutes. Alternatively, the storage 135 may store therein sound frequency data, vibration frequency data, and a status identifier every time the image forming section 110 forms an image on a sheet S.

Note that although the collection of data illustrated in FIG. 3D is typically obtained when the user uses the image forming apparatus 100, the collection of data illustrated in FIG. 3C may be obtained when the user uses the image forming apparatus 100, or obtained while the developer or manufacturer of the image forming apparatus 100 is developing or manufacturing the image forming apparatus 100. For example, the collection of data illustrated in FIG. 3C may be obtained at durability test during development.

It is preferable that when the predicting section 140 performs the machine learning, the storage 135 stores therein sound frequency data and vibration frequency data for each operation of the image forming section 110 as illustrated in FIG. 3C. In contrast, when the predicting section 140 predicts a malfunction of the image forming section 110 as illustrated in FIG. 3D, the generating section 130 may generate sound frequency data and vibration frequency data only when an amplitude of sound or vibration in the image forming section 110 measured by the measuring section 120 exceeds a predetermined value. This causes the image forming section 110 to predict a malfunction to occur of the image forming section 110 only when the malfunction occurrence probability of the image forming section 110 is likely to increase, thereby making it possible to efficiently eliminate arithmetic processing when the possibility of malfunction occurrence is low.

Note that although sound and vibration are measured when the image forming section 110 forms an image on a sheet S in a normal printing mode in the above description with reference to FIGS. 3A to 3D, the present embodiment is not limited to this. The sound and the vibration may be measured when the apparatus controller 132 operates in a test mode that is different from the normal printing mode of the image forming section 110.

For example, when a rotational speed of the conveyance rollers 114*a* changes, the sound and the vibration due to the image forming section 110 change. For example, the measuring section 120 may measure sound and vibration due to the image forming section 110 when the conveyance rollers 114*a* rotate according to a test mode corresponding to a conveyance speed 0.5 to 0.9 times a conveyance speed of the normal printing mode. Alternatively, the measuring section 120 may measure sound and vibration due to the image forming section 110 when the conveyance rollers 114*a* rotate according to a test mode corresponding to a conveyance speed 1.1 to 2.0 times the conveyance speed of the normal printing mode.

When temperature of the fixing section 116*i* rises, the fixing section 116*i* expands and thereby the sound and the vibration due to the image forming section 110 change. For example, the measuring section 120 may measure sound and vibration due to the image forming section 110 when the fixing section 116*i* performs heating according to a test mode corresponding to temperature 0.5 to 0.9 times fixing temperature of the normal printing mode. Alternatively, the measuring section 120 may measure sound and vibration due to the image forming section 110 when the fixing section 116*i* performs heating according to a test mode corresponding to temperature 1.1 to 1.5 times the fixing temperature of the normal printing mode.

Note that although FIG. 3C illustrates that the storage 135 stores therein sound frequency data and vibration frequency data sequentially measured as learning data in order to facilitate understanding of the present disclosure, the present embodiment is not limited to this. When learning is performed through the CNN process, the storage 135 needn't sequentially store therein the learning data. The storage 135 may sequentially update respective weighting coefficients corresponding to sound frequency data, vibration frequency data, and a status identifier as the learning data.

Note that although the measuring section 120 measures both sound and vibration in the above description with reference to FIGS. 3A to 3D, the present embodiment is not limited to this. The measuring section 120 may measure only one of the sound and the vibration.

Figure 4:
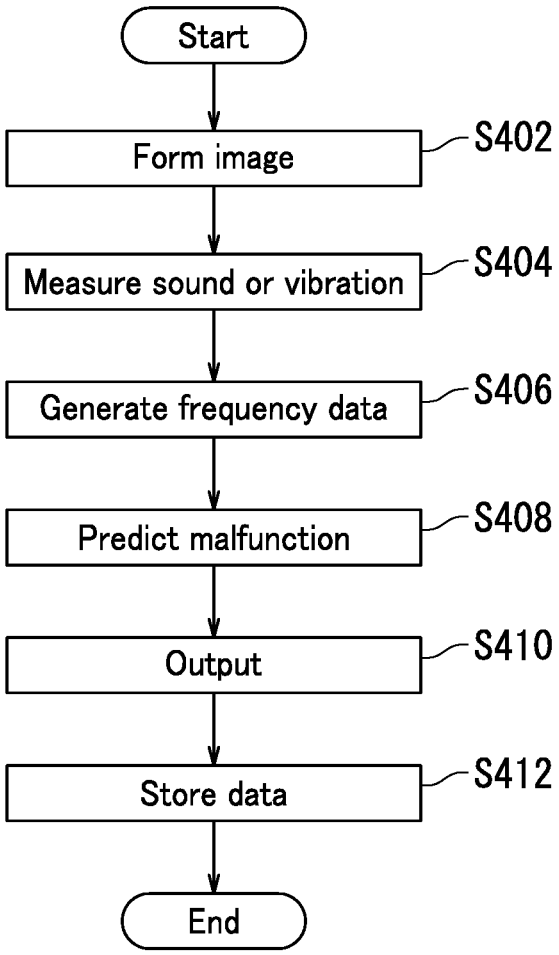
FIG. 4 is a flowchart illustrating an image forming method according to the present embodiment.

An image forming method for the image forming apparatus 100 according to the present embodiment will next be described with reference to FIGS. 1 to 4. FIG. 4 is a flowchart illustrating an image forming process by the image forming apparatus 100 according to the present embodiment.

At Step S402, the process includes starting image formation. The image forming section 110 forms an image on a sheet S.

At step S404, when the image forming section 110 forms the image on the sheet S, the measuring section 120 measures sound or vibration due to the image forming section 110. For example, the measuring section 120 measures the sound or the vibration before start of conveyance of the sheet S in the image forming section 110, during the conveyance of the sheet S in the image forming section 110, or after ejection of the sheet S with the image formed thereon outside the image forming apparatus 100.

The sound measuring section 122 measures sound of the motors of the image forming section 110. Alternatively, the sound measuring section 122 measures sound of a sheet S being conveyed in the image forming section 110. Alternatively or additionally, the vibration measuring section 124 measures vibration due to the motors of the image forming section 110. Alternatively, the vibration measuring section 124 measures vibration applied to the sheet S being conveyed in the conveyance section 114.

At Step S406, the generating section 130 generates frequency data through a frequency analysis of the measurement result by the measuring section 120.

At Step S408, the predicting section 140 predicts a malfunction to occur of the mage forming section 110. The predicting section 140 predicts the malfunction to occur of the image forming section 110 according to the frequency data based on the learning data including past pieces of frequency data and past status identifiers. For example, the predicting section 140 learns the past pieces of frequency data and the past status identifiers of the image forming section 110 in advance. The classifier is produced by the learning. The predicting section 140 predicts the malfunction to occur of the image forming section 110 based on the frequency data.

At Step S410, the output section 150 outputs a prediction result. Typically, when the predicting section 140 predicts that a malfunction will occur in the image forming section 110, the output section 150 outputs the prediction result. The output section 150 may however output the prediction result even when the predicting section 140 predicts that a malfunction will not occur in the image forming section 110.

At Step S412, the storage 135 stores therein the sound frequency data and the vibration frequency data as well as the status identifier of the image forming section 110. This enables utilization of the learning data, in which a current measurement result and a current generation result are contained, as next learning data. The image forming process can be performed as described above.

Note that when it is predicted that a malfunction will occur with high probability in the image forming section 110, the output section 150 may prompt the user to change the setting so that occurrence timing of the malfunction of the image forming section 110 is postponed, at Step S410. For example, the display section 152 may display a screen that prompts the user to change the setting so that the conveyance speed of the sheet is decreased. Alternatively, the display section 152 may display a screen that prompts the user to apply oil so that abrasion of a member with a high possibility of malfunction occurrence is reduced. For example, the display section 152 may display a screen that prompts the user to apply oil to the conveyance rollers 114*a*.

Alternatively, the display section 152 may display a screen that prompts the user to directly or indirectly temporarily press a member with a high possibility of malfunction occurrence. For example, the display section 152 may display a screen that prompts the user to press a specific place of the housing of the image forming apparatus 100.

Note that although the learning data includes pieces of sound frequency data, pieces of vibration frequency data, and status identifiers of the image forming section 110 in the above description with reference to FIG. 3C, the present embodiment is not limited to this. The learning data may further include different data. For example, in addition to the pieces of sound frequency data, the pieces of vibration frequency data, and the status identifiers of the image forming section 110, the learning data may include a type of operation of the image forming section 110 and/or cumulative number of prints of the image forming section 110.

The image forming apparatus 100 according to the embodiment will next be described with reference to FIGS. 1 to 5B. FIG. 5A is a table depicting learning data. The storage 135 stores the table as the learning data. Here, as illustrated in FIG. 5A, the storage 135 stores therein the table that represents, for each row, a data number, a sound and vibration measurement date and time, sound frequency data, vibration frequency data, a printing condition, a cumulative number of prints, and a status identifier of the image forming section 110.

In the table illustrated in FIG. 5A, the date and time; the sound frequency data; the vibration frequency data; the printing condition; the cumulative number of prints; and the status identifier of the image forming section 110 included in 51st data represent 14:26 on Sep. 2, 2018; D51; d51; monochrome, 2in1, 4 prints; 5030; and normal, respectively. In addition, the date and time; the sound frequency data; the vibration frequency data; the printing condition; the cumulative number of prints; and the status identifier of the image forming section 110 included in 52nd data represent 14:43 on Sep. 2, 2018; D52; d52; color, 2 prints; 5032; and normal, respectively.

The date and time; the sound frequency data; the vibration frequency data; the printing condition; the cumulative number of prints; and the status identifier of the image forming section 110 included in 53rd data represent 14:57 on Sep. 2, 2018; D53; d53; monochrome, 4in1, 16 prints; 5048; and abnormal, respectively. In addition, the date and time; the sound frequency data; the vibration frequency data; the printing condition; the cumulative number of prints; and the status identifier of the image forming section 110 included in 54th data represent 15:01 on Sep. 2, 2018; D54; d54; color, 2in1, 2 prints; 5050; and normal, respectively. From this, it is understood that a malfunction occurred in the image forming section 110 before 15:00 on Sep. 2, 2018, and then the malfunction was solved by some method.

The predicting section 140 predicts a malfunction to occur of the image forming section 110 based on the learning data. Note that the learning data is not limited to data measured or generated in the image forming apparatus 100 according to the present embodiment, but data measured or generated in a different image forming apparatus may be utilized as the learning data. The image forming apparatus utilizing the data in this case preferably has the same configuration as that of the image forming apparatus 100 according to the present embodiment.

FIG. 5B is a table that represents, for each row, a data number, a sound and vibration measurement date and time, sound frequency data, vibration frequency data, a printing condition, a cumulative number of prints, and a malfunction occurrence probability. Here, the date and time; the sound frequency data; the vibration frequency data; the printing condition; and the cumulative number of prints included in 153rd data represent 10:08 on Sep. 8, 2018; D153; d153; monochrome, 2in1, 4 prints; and 4258, respectively. In this case, the predicting section 140 predicts occurrence of a malfunction of the image forming section 110 based on the sound frequency data of D153, the vibration frequency data of d153, the printing condition, the cumulative number of prints, and the learning data. In this case, the malfunction occurrence probability is 10%.

The date and time; the sound frequency data; the vibration frequency data; the printing condition; and the cumulative number of prints included in 154th data represent 10:53 on Sep. 8, 2018; D154; d154; color, 2 prints; and 4260, respectively. In this case, the predicting section 140 predicts occurrence of a malfunction of the image forming section 110 based on the sound frequency data of D154, the vibration frequency data of d154, the printing condition, the cumulative number of prints, and the learning data. In this case, the malfunction occurrence probability is 15%.

The date and time; the sound frequency data; the vibration frequency data; the printing condition; and the cumulative number of prints included in 155th data represent 11:27 on Sep. 8, 2018; D155; d155; monochrome, 4in1, 16 prints; and 4276, respectively. In this case, the predicting section 140 predicts occurrence of a malfunction of the image forming section 110 based on the sound frequency data of D155, the vibration frequency data of d155, the printing condition, and the cumulative number of prints, and the learning data. In this case, the malfunction occurrence probability is 80%. As stated above, the malfunction to occur of the image forming section 110 can be predicted.

Note that although the learning data in the description with reference to FIGS. 5A and 5B includes the sound frequency data and the vibration frequency data as well as the printing condition and the cumulative number of prints, the present embodiment is not limited to this. In addition to the sound frequency data and the vibration frequency data, the learning data may include one of the printing condition and the cumulative number of prints.

Alternatively or additionally, the learning data may include an environmental condition in addition to the sound frequency data and the vibration frequency data. For example, the learning data may include temperature measured by the temperature measuring section 170. Alternatively or additionally, the learning data may include humidity of the image forming section 110.

Note that although the sound measuring section 122 and the vibration measuring section 124 in the image forming apparatus 100 illustrated in FIG. 1 measure sound and vibration of the entire image forming section 110, the present embodiment is not limited to this. The embodiment may be configured so that the image forming apparatus 100 includes, as the sound measuring section 122 and the vibration measuring section 124, sound measuring sections 122 and vibration measuring sections 124 disposed for each part of the image forming section 110, and the predicting section 140 predicts a malfunction to occur for each part of the image forming section 110.

Figure 6:
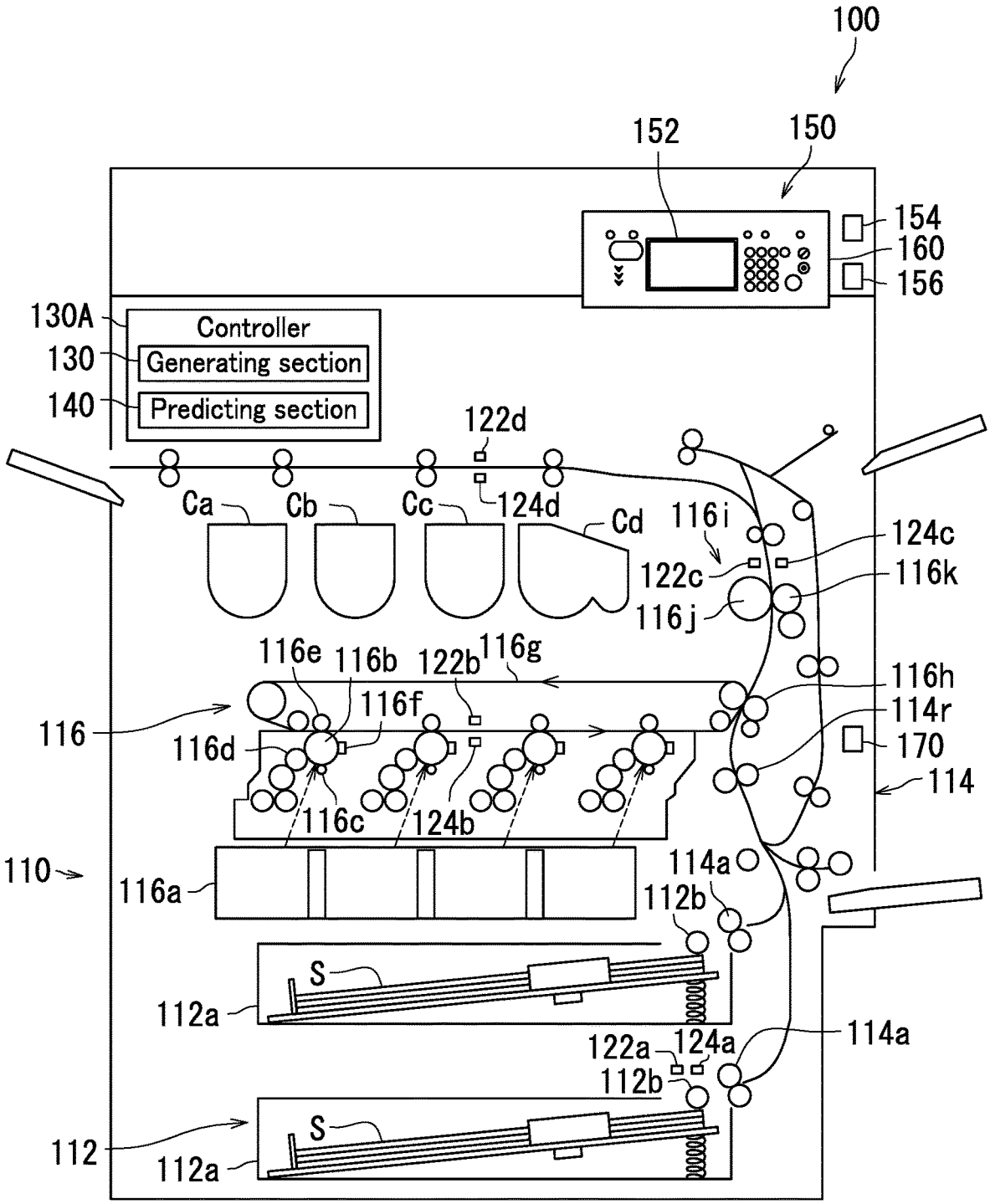
FIG. 6 is a schematic illustration of the image forming apparatus according to the present embodiment.

The image forming apparatus 100 according to the embodiment will next be described with reference to FIG. 6. FIG. 6 is a schematic illustration of the image forming apparatus 100 according to the present embodiment. The image forming apparatus 100 illustrated in FIG. 6 is similar to the image forming apparatus described above with reference to FIG. 1 except that the image forming apparatus 100 illustrated in FIG. 6 includes sound sensors and vibration sensors. Duplicate descriptions are therefore omitted for the purpose of avoiding redundancy.

Here, the sound measuring section 122 includes the sound sensors. For example, the sound measuring section 122 includes a first sound sensor 122*a*, a second sound sensor 122*b*, a third sound sensor 122*c*, and a fourth sound sensor 122*d*.

On the other hand, the vibration measuring section 124 includes the vibration sensors. For example, the vibration measuring section 124 includes a first vibration sensor 124*a*, a second vibration sensor 124*b*, a third vibration sensor 124*c*, and a fourth vibration sensor 124*d*.

Here, the sound sensors and the vibration sensor are arranged in pairs. The first sound sensor 122*a* and the first vibration sensor 124*a* are disposed adjacent to a feeding roller 112*b*. The second sound sensor 122*b* and the second vibration sensor 124*b* are disposed adjacent to the intermediate transfer belt 116*g*. The third sound sensor 122*c* and the third vibration sensor 124*c* are disposed adjacent to the fixing section 116*i*. The fourth sound sensor 122*d* and the fourth vibration sensor 124*d* are disposed adjacent to the conveyance rollers 114*a* disposed downstream of the fixing section 116*i* in the conveyance path.

The image forming apparatus 100 according to the present embodiment will next be described with reference to FIGS. 1, 6, 7A, and 7B. FIG. 7A is a table that represents, for each row, a data number, a sound and vibration measurement date and time, respective pieces of frequency data corresponding to the first to fourth sound sensors 122*a* to 122*d*, respective pieces of frequency data corresponding to the first to fourth vibration sensors 124*a* to 124*d*, and respective status identifiers. The storage 135 stores therein the table. Here, as illustrated in FIG. 7A, the storage 135 stores therein, as learning data, the table that represents, for each row, the respective pieces of frequency data corresponding to the first to fourth sound sensors 122*a* to 122*d*, the respective pieces of frequency data corresponding to the first to fourth vibration sensors 124*a* to 124*d*, and the respective status identifiers corresponding to these pairs (in this example, four pairs) of sensors.

In the table illustrated in FIG. 7A, the date and time, the frequency data corresponding to the first sound sensor 122*a*, the frequency data corresponding to the first vibration sensor 124*a*, and the status identifier of the feeding roller 112*b* included in 42nd data represent 10:36 on Sep. 5, 2018, Da42, da42, and normal, respectively. In addition, the frequency data corresponding to the second sound sensor 122*b*, the frequency data corresponding to the second vibration sensor 124*b*, and the status identifier of the intermediate transfer belt 116*g* included in the 42nd data represent Db42, db42, normal, respectively. Note that although the table illustrated in FIG. 7A includes the respective pieces of frequency data corresponding to the third and fourth sound sensors 122*c* and 122*d*, the respective pieces of frequency data corresponding to the third and fourth vibration sensors 124*c* and 124*d*, and the respective status identifiers of the fixing section 116*i* and the conveyance rollers 114*a* disposed downstream of the fixing section 116*i* in the conveyance path, these data and these identifiers are omitted in FIG. 7A.

The date and time, the frequency data corresponding to the first sound sensor 122*a*, the frequency data corresponding to the first vibration sensor 124*a*, and the status identifier of the feeding roller 112*b* included in 43rd data represent 10:58 on Sep. 5, 2018, Da43, da43, normal, respectively. In addition, the frequency data corresponding to the second sound sensor 122*b*, the frequency data corresponding to the second vibration sensor 124*b*, and the status identifier of the intermediate transfer belt 116*g* included in the 43rd data represent Db43, db43, and abnormal, respectively.

The date and time, the frequency data corresponding to the first sound sensor 122*a*, the frequency data corresponding to the first vibration sensor 124*a*, and the status identifier of the feeding roller 112*b* included in 44th data represent 11:42 on Sep. 5, 2018, Da44, da44, and abnormal, respectively. In addition, the frequency data corresponding to the second sound sensor 122*b*, the frequency data corresponding to the second vibration sensor 124*b*, and the status identifier of the intermediate transfer belt 116*g* included in the 44th data represent Db44, db44, normal, respectively. From this, it is understood that a malfunction occurred in the intermediate transfer belt 116*g* of the image forming section 110 around 11:00 on Sep. 5, 2018, and then the malfunction was solved by some method.

The date and time, the frequency data corresponding to the first sound sensor 122*a*, the frequency data corresponding to the first vibration sensor 124*a*, and the status identifier of the feeding roller 112*b* included in 45th data represent 12:15 on Sep. 5, 2018, Da45, da45, normal, respectively. In addition, the frequency data corresponding to the second sound sensor 122*b*, the frequency data corresponding to the second vibration sensor 124*b*, and the status identifier of the intermediate transfer belt 116*g* included in the 45th data represent Db45, db45, normal, respectively. From this, it is understood that a malfunction occurred in the second sound sensor 122*b* of the image forming section 110 around 12:00 on Sep. 5, 2018, and then the malfunction was solved by some method.

The predicting section 140 predicts a malfunction to occur in each of the parts in the image forming section 110 based on the learning data. FIG. 7B is a table that represent, for each row, a data number, a sound and vibration measurement date and time, respective pieces of frequency data corresponding to the first to fourth sound sensors 122*a* to 122*d*, respective pieces of frequency data corresponding to the first to fourth vibration sensors 124*a* to 124*d*, and respective malfunction occurrence probabilities corresponding to these pairs (in this example, four pairs) of sensors.

Here, the date and time, the frequency data corresponding to the first sound sensor 122*a*, the frequency data corresponding to the first vibration sensor 124*a*, and the malfunction occurrence probability of the feeding roller 112*b* included in 122nd data represent 13:22 on Sep. 8, 2018, Da122, da122, and 15%, respectively. In addition, the frequency data corresponding to the second sound sensor 122*b*, the frequency data corresponding to the second vibration sensor 124*b*, and the malfunction occurrence probability of the intermediate transfer belt 116*g* included in the 122nd data represent Db122, db122, and 2%, respectively.

The date and time, the frequency data corresponding to the first sound sensor 122*a*, the frequency data corresponding to the first vibration sensor 124*a*, and the malfunction occurrence probability of the feeding roller 112*b* included in 123rd data represent 14:51 on Sep. 8, 2018, Da123, da123, and 3%, respectively. In addition, the frequency data corresponding to the second sound sensor 122*b*, the frequency data corresponding to the second vibration sensor 124*b*, and the malfunction occurrence probability of the intermediate transfer belt 116*g* included in the 123rd data represent Db123, db123, and 95%, respectively.

The date and time, the frequency data corresponding to the first sound sensor 122*a*, the frequency data corresponding to the first vibration sensor 124*a*, and the malfunction occurrence probability of the feeding roller 112*b* included in 124th data represent 15:36 on Sep. 8, 2018, Da124, da124, and 85%, respectively. In addition, the frequency data corresponding to the second sound sensor 122*b*, the frequency data corresponding to the second vibration sensor 124*b*, and the malfunction occurrence probability of the intermediate transfer belt 116*g* included in the 124th data represent Db124, db124, and 10%, respectively.

The image forming apparatus 100 according to the present embodiment enables prediction of malfunction occurrence of a corresponding part of the image forming section 110 for each part of the image forming section 110. This enables the user, the administrator or the maintenance person of the image forming apparatus 100 to prepare a spare part for the part in which a malfunction is likely to occur, thereby quickly replacing the part in which the malfunction has occurred with the spare part.

Note that although the image forming apparatus 100 includes the four sound sensors and the four vibration sensors in the above description with reference to FIGS. 6, 7A, and 7B, the present embodiment is not limited to this. The number of the sound sensors and the number of the vibration sensors may be any number other than 4 each. Alternatively, the occurrence of the malfunction of each part may be predicted based on measurement results of sound sensors, measurement results of vibration sensors, or respective measurement results of the sound and vibration sensors.

Figure 8:
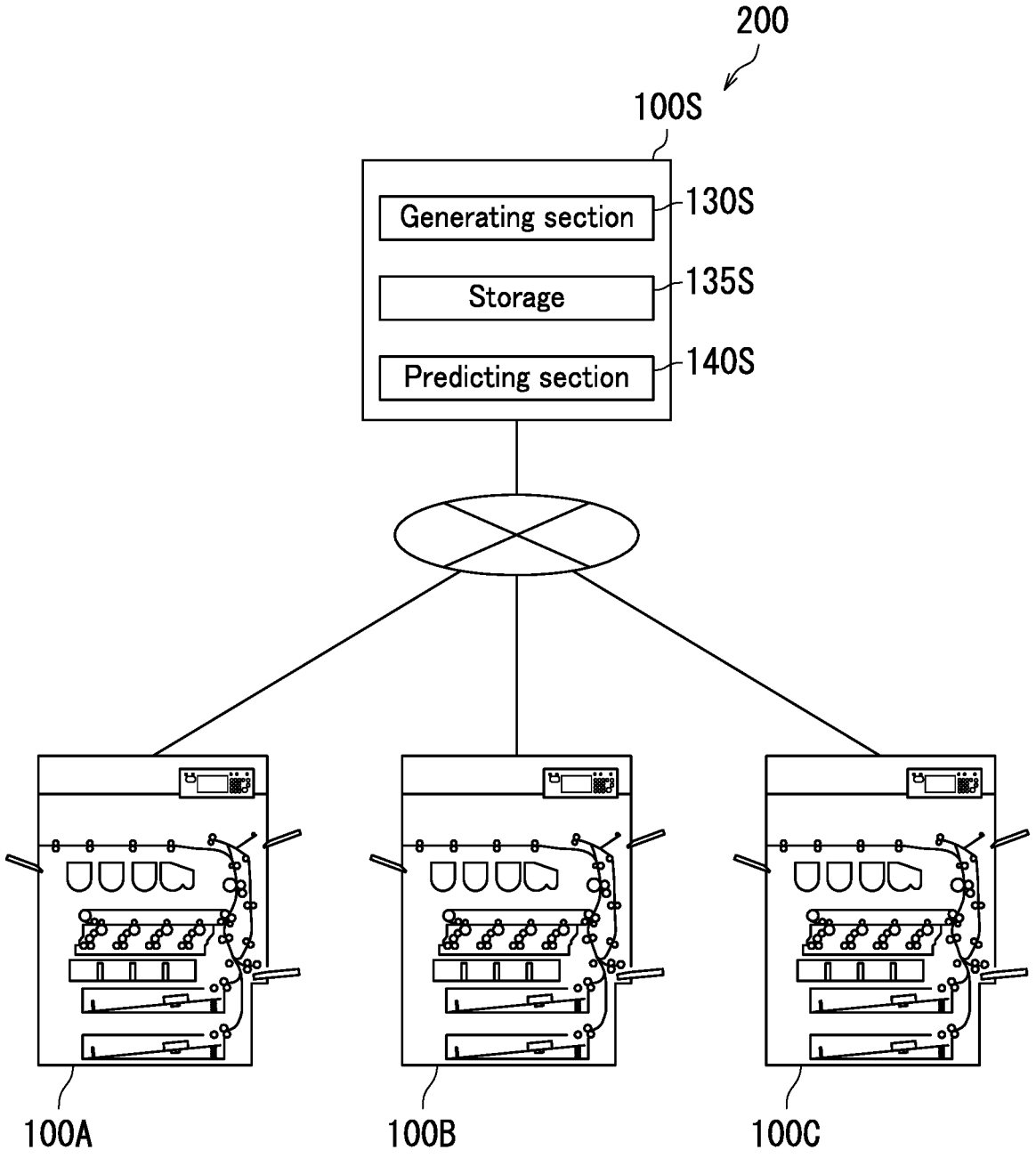
FIG. 8 is an image forming system including the image forming apparatus according to the present embodiment.

An image forming system 200 including the image forming apparatus according to the present embodiment will next be described with reference to FIGS. 1, 2, and 8. FIG. 8 is a schematic illustration of the image forming system 200.

The image forming system 200 includes a first image forming apparatus 100A, a second image forming apparatus 100B, a third image forming apparatus 100C, and an information processing device 100S. The information processing device 100S is mutually connected to each of the first to third image forming apparatuses 100A to 100C via a network N. For example, the information processing device 100S may be a server.

Each of the first to third image forming apparatuses 100A to 100C has a similar configuration to that of the image forming apparatus 100 described above with reference to FIGS. 1 to 7B. Note that here, an image forming section 110, a generating section 130, and a predicting section 140 of the first image forming apparatus 100A are referred to as a "first image forming section", a "first generating section", and a "first predicting section", respectively. Similarly, a sound measuring section 122 and a vibration measuring section 124 of the first image forming apparatus 100A are referred to as a "first sound measuring section" and a "first vibration measuring section", respectively.

Similarly, an image forming section 110, a generating section 130, and a predicting section 140 of the second image forming apparatus 100B are referred to as a "second image forming section", a "second generating section", and a "second predicting section", respectively. A sound measuring section 122 and a vibration measuring section 124 of the second image forming apparatus 100B are referred to as a "second sound measuring section" and a "second vibration measuring section", respectively. Furthermore, an image forming section 110, a generating section 130, and a predicting section 140 of the third image forming apparatus 100C are referred to as a "third image forming section", a "third generating section", and a "third predicting section", respectively. A sound measuring section 122 and a vibration measuring section 124 of the third image forming apparatus 100C are referred to as a "third sound measuring section" and a "third vibration measuring section", respectively.

The information processing device 100S includes a generating section 130S, storage 135S, and a predicting section 140S. The first to third image forming apparatuses 100A to 100C may transmit respective sound measurement results and respective vibration measurement results measured by the first to third sound measuring sections and the first to third vibration measuring sections to the information processing device 100S. The storage 135S may store therein the respective sound measurement results and the respective vibration measurement results. In this case, the first to third image forming apparatuses 100A to 100C may transmit, along with the respective sound measurement results and respective vibration measurement results, respective status identifiers at the measurement time of the respective measurement results. The storage 135S may store therein the respective status identifiers of the first to third image forming apparatuses 100A to 100C along the sound and vibration measurement results.

The information processing device 100S may transmit, to at least one image forming apparatus, the measurement results and/or the status identifiers of the other image forming apparatuses. For example, the information processing device 100S may transmit the measurement results and/or the status identifiers of the second and third image forming apparatuses 100B and 100C to the first image forming apparatus 100A.

This configuration enables the generating section 130S to generate respective pieces of sound frequency data and respective pieces of vibration frequency data based on the sound measurement results by the first to third sound measuring sections and the vibration measurement results by the first to third vibration measuring sections. The information processing device 100S may subsequently transmit, to at least one image forming section, the pieces of sound frequency data and the pieces of vibration frequency data of other image forming apparatuses. For example, the information processing device 100S may transmit the pieces of sound frequency data and the pieces of vibration frequency data based on the sound measurement results and the vibration measurement results of the second and third image forming apparatuses 100B and 100C to the first image forming apparatus 100A.

This configuration enables the predicting section 140S to predict respective malfunctions to occur of the first to third image forming apparatuses 100A to 100C based on the pieces of sound frequency data, the pieces of vibration frequency data, and the status identifiers. The information processing device 100S may subsequently transmit respective malfunction prediction results of the first to third image forming sections to the first to third image forming apparatuses 100A to 100C. For example, the information processing device 100S transmits the malfunction prediction result of the first image forming section to the first image forming apparatus 100A. In this case, the first predicting section of the first image forming apparatus 100A predicts a malfunction to occur of the first image forming section based on the prediction result received from the information processing device 100S.

Note that data generated by the generating section of an image forming apparatuses may be weighted higher than data generated by the generating section of a different image forming apparatus. For example, it is assumed that in the first image forming apparatus 100A, the first predicting section predicts a malfunction to occur of the first image forming section based on data generated by the first generating section and respective pieces of data generated by the second and third generating sections. In this case, the data generated by the first generating section may be weighted higher than the respective pieces of data generated by the second and third generating sections.

The image forming system 200 according to the present embodiment will next be described with reference to FIGS. 1, 8, 9A, and 9B. FIG. 9A is a table that represents for each row, a data number, a sound and vibration measurement date and time, respective pieces of frequency data corresponding to the first to third sound measuring sections, respective pieces of frequency data corresponding to the first to third vibration measuring sections, and respective status identifiers of the first to third image forming sections. The storage 135S stores therein the table. Here, as illustrated in FIG. 9A, the storage 135S stores therein, as learning data, the respective pieces of data corresponding to the first to third sound measuring sections, the respective pieces of data corresponding to the first to third vibration measuring sections, and the respective status identifiers of the first to third image forming sections.

In the table depicted in FIG. 9A, the date and time, the frequency data corresponding to the first sound measuring section, the frequency data corresponding to the first vibration measuring section, and the status identifier of the first image forming section included in 28th data represent 10:05 on Sep. 3, 2018, Da28, da28, and normal, respectively. The frequency data corresponding to the second sound measuring section, the frequency data corresponding to the second vibration measuring section, and the status identifier of the second image forming section included in the 28th data represent Db28, db28, normal, respectively. Note that although the table depicted in FIG. 9A includes the pieces of data of the third image forming apparatus, the pieces of data are not depicted.

The date and time, the frequency data corresponding to the first sound measuring section, the frequency data corresponding to the first vibration measuring section, and the status identifier of the first image forming section included in 29th data represent 11:30 on Sep. 3, 2018, Da29, da29, normal, respectively. The frequency data corresponding to the second sound measuring section, the frequency data corresponding to the second vibration measuring section, and the status identifier of the second image forming section included in the 29th data represent Db29, db29, and abnormal, respectively.

The date and time, the frequency data corresponding to the first sound measuring section, the frequency data corresponding to the first vibration measuring section, and the status identifier of the first image forming section included in 30th data represent 13:45 on Sep. 3, 2018, Da30, da30, and abnormal, respectively. The frequency data corresponding to the second sound measuring section, the frequency data corresponding to the second vibration measuring section, and the status identifier of the second image forming section included in the 30th data represent Db30, db30, and normal, respectively. From this, it is understood that a malfunction occurred in the second image forming apparatus 100B around 13:00 on Sep. 3, 2018, and then the malfunction was solved by some method.

The date and time, the frequency data corresponding to the first sound measuring section, the frequency data corresponding to the first vibration measuring section, and the status identifier of the first image forming section included in 31st data represent 14:15 on Sep. 3, 2018, Da31, da31, normal, respectively. From this, it is understood that a malfunction occurred in the first image forming apparatus 100A around 14:00 on Sep. 3, 2018, and then the malfunction was solved by some method. The frequency data corresponding to the second sound measuring section, the frequency data corresponding to the second vibration measuring section, and the status identifier of the second image forming section included in the 31st data represent Db31, db31, normal, respectively.

The predicting section 140 predicts respective malfunctions to occur of the first to third image forming sections based on the learning data. FIG. 9B is a table that represents for each row, a data number, a sound and vibration measurement date and time, respective pieces of frequency data corresponding to the first to third sound measuring sections, respective pieces of frequency data corresponding to the first to third vibration measuring sections, and respective malfunction occurrence probabilities of the first to third image forming apparatuses.

Here, the date and time, the frequency data corresponding to the first sound measuring section, and the frequency data corresponding to the first vibration measuring section included in 86th data represent 11:12 on Sep. 9, 2018, Da86, and da86, respectively. According to this, the predicting section 140S predicts occurrence of a malfunction of the first image forming apparatus 100A. In this case, the malfunction occurrence probability is 3%. The frequency data corresponding to the second sound measuring section, and the frequency data corresponding to the second vibration measuring section included in the 86th data represent Db86 and db86, respectively. According to this, the predicting section 140S predicts occurrence of a malfunction of the second image forming apparatus 100B. In this case, the malfunction occurrence probability is 2%.

The date and time, the frequency data corresponding to the first sound measuring section, and the frequency data corresponding to the first vibration measuring section included in 87th data represent 13:04 on Sep. 9, 2018, Da87, and da87, respectively. According to this, the predicting section 140S predicts occurrence of a malfunction of the first image forming apparatus 100A. In this case, the malfunction occurrence probability is 4%. The frequency data corresponding to the second sound measuring section, and the frequency data corresponding to the second vibration measuring section included in the 87th data represent Db87 and db87, respectively. According to this, the predicting section 140S predicts occurrence of a malfunction of the second image forming apparatus 100B. In this case, the malfunction occurrence probability is 96%.

The date and time, the frequency data corresponding to the first sound measuring section, and the frequency data corresponding to the first vibration measuring section included in 88th data represent 14:50 on Sep. 9, 2018, Da88, and da88, respectively. According to this, the predicting section 140S predicts occurrence of a malfunction of the first image forming apparatus 100A. In this case, the malfunction occurrence probability is 89%. The frequency data corresponding to the second sound measuring section, and the frequency data corresponding to the second vibration measuring section included in the 88th data represent Db88 and db88, respectively. According to this, the predicting section 140S predicts occurrence of a malfunction of the second image forming apparatus 100B. In this case, the malfunction occurrence probability is 5%.

As stated above, the image forming system 200 according to the present embodiment enables prediction of malfunction occurrence for each of the first to third image forming apparatuses 100A to 100C based on the learning data and the pieces of data from each of the first to third image forming apparatuses 100A to 100C.

Note that although the image forming apparatus 100 is an electrographic apparatus, the present embodiment is not limited to this. The image forming apparatus 100 may be other types of apparatus. For example, the image forming apparatus 100 may be an inkjet apparatus.

The embodiment of the present disclosure has been described above with reference to the accompanying drawings. Note that the present disclosure is not limited to the above-described embodiment, but is applicable to various aspects without departing from the scope of gist thereof. Furthermore, variations may be formed by appropriately combining elements of configuration disclosed in the above embodiment. For example, some of the elements of configuration disclosed in the embodiment may be removed. In addition, elements of configuration from different embodiment examples may be appropriately combined. The drawings schematically illustrate main elements of configuration to facilitate understanding thereof. Aspects of the elements of configuration illustrated in the drawings, such as thickness, length, number and interval, may differ in practice for the sake of convenience for drawing preparation. Furthermore, aspects of the elements of configuration illustrated in the above embodiment, such as material, shape, and dimension, are one example and are not particularly limited. The elements of configuration may be variously altered within a scope not substantially departing from the configuration of the present disclosure.

What is claimed is:

1. An image forming apparatus, comprising:

an image forming section configured to from an image on a sheet;

a measuring section configured to measure sound or vibration in the image forming section to obtain a measurement result;

a generating section configured to generate frequency data through a frequency analysis of the measurement result; and a predicting section configured to predict a malfunction to occur of the image forming section according to the frequency data based on learning data including past pieces of frequency data.

2. The image forming apparatus according to claim 1, wherein the predicting section predicts a failure to occur of the mage forming section based on the frequency data.

3. The image forming apparatus according to claim 1, wherein the predicting section predicts the malfunction through a convolutional neural network process.

4. The image forming apparatus according to claim 1, wherein the generating section generates the frequency data through a fast Fourier transform of the measurement result.

5. The image forming apparatus according to claim 1, further comprising a communication section configured to communicate with an external device.

6. The image forming apparatus according to claim 5, wherein the communication section transmits the measurement result by the measuring section or the frequency data generated by the generating section to the external device.

7. The image forming apparatus according to claim 5, wherein the communication section receives a measurement result of sound or vibration in a different image forming apparatus or frequency data generated by the different image forming apparatus.

8. The image forming apparatus according to claim 5, wherein the communication section transmits an estimation result by the predicting section to the external device.

9. An image forming method, comprising:

forming an image on a sheet by an image forming section;

measuring sound or vibration in the image forming section to obtain a measurement result;

generating frequency data through a frequency analysis of the measurement result; and predicting a malfunction to occur of the image forming section according to the frequency data based on learning data including past pieces of frequency data.

* * * * *